US005624328A

United States Patent [19]

Lovich

[11] Patent Number: 5,624,328

[45] Date of Patent: Apr. 29, 1997

[54] GOLF CLUB INCLUDING A STAND

[76] Inventor: Stephen F. Lovich, 4520 St. Andrews Ct., Suisun, Calif. 94585

[21] Appl. No.: 639,965

[22] Filed: Apr. 29, 1996

[51] Int. Cl.[6] ..... A63B 53/00; A63B 53/16

[52] U.S. Cl. ..... 473/282; 473/286; 473/229; 473/243; 248/685

[58] Field of Search ..... 473/282, 286, 473/408, 243, 229; 248/685

[56] References Cited

U.S. PATENT DOCUMENTS

| | | | |
|---|---|---|---|
| 4,063,731 | 12/1977 | Kitay | 273/32 B |
| 4,210,334 | 7/1980 | Lind | 273/162 R |
| 4,545,579 | 10/1985 | McCain | 273/162 R |
| 4,805,911 | 2/1989 | Ferlazzo | 273/162 R |
| 4,925,190 | 5/1990 | Learned | 473/286 |
| 5,076,581 | 12/1991 | Boberg | 273/32 R |
| 5,377,977 | 1/1995 | MacNeary | 473/286 |
| 5,423,543 | 6/1995 | Tarrant | 473/286 |
| 5,511,785 | 4/1996 | Rusin | 473/286 |

*Primary Examiner*—George J. Marlo
*Attorney, Agent, or Firm*—Robert Charles Hill

[57] ABSTRACT

An improved golf club stand that enables a golf club to be inverted and supported above the ground in a substantially vertical position is provided. In a first embodiment, the stand includes a sleeve secured in the handle of the club and a spike. The spike is tapered at a first end and is configured at a second end to be detachably coupled to the sleeve. In a second embodiment, the spike is retained in the handle of the club. The sleeve has a slotted open end that prevents the spike from being dislodged from the sleeve and enables a portion of the spike to pass therethrough. The disk end of the spike also prevents the spike from completely passing through the slotted end. The sleeve is configured to prevent the spike from retracting fully into the sleeve and drop into the club's shaft. When inserted in the ground, the invented stand aids with keeping the grip of the club dry and unsoiled. Since the club is retained substantially vertical to the ground, the club is highly visible and less likely to be forgotten by the golfer. The invented stand does not substantially alter the club, so the club may be used normally by the golfer.

15 Claims, 2 Drawing Sheets

FIG._1B
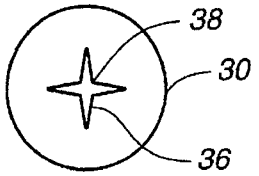
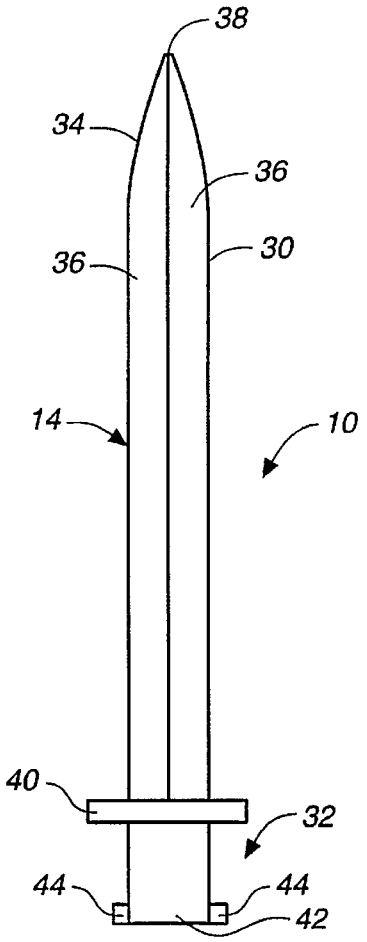
FIG._1A
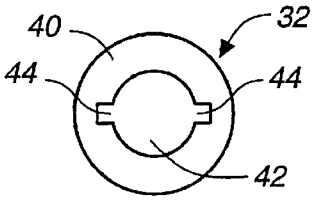
FIG._1C
FIG._2B
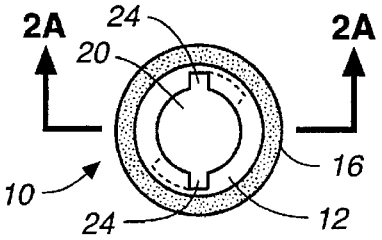
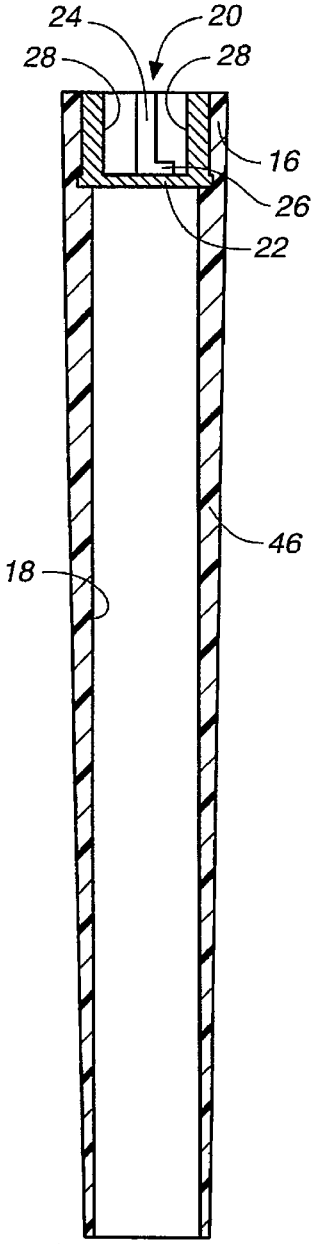
FIG._2A

GOLF CLUB INCLUDING A STAND

BACKGROUND OF THE INVENTION

1. Field of the Invention

The present invention relates generally to golfing accessories, and more particularly, to an improved and simplified golf club stand.

2. Description of Related Art

A well known inconvenience of golfing is that a golfer must frequently place one of their golf clubs on the ground. Situations frequently arise where it is necessary for the golfer to place a golf club on the ground, which usually comprises damp or wet grass. One recurring situation is when coming to a putting green, the golfer will bring a club for their approach shot to the green along with their putter for putting on the green, to facilitate their speed of play. When golfers prepare to putt, they typically place their chipping club on the fringe of the green, prior to putting.

However, placing the club on the grass often dampens or dirties the grip and shaft of the club. Additionally, after playing out the hole, golfers are usually occupied with adding their score of the hole and preparing for the next coming hole, for example. Since a golf club lying flatly on the grass is not readily visible, the chipping club may be forgotten by the golfer, potentially resulting in losing the club.

A number of devices in the prior art have attempted to solve such problems. One such device is disclosed in U.S. Pat. No. 5,076,581, to Boberg, which is directed to a prop for a handgrip of a golf club. The prop comprises a body having a generally round aperture extending through the body. The aperture is sized and configured to retain the handgrip of the golf club therein. The body has spaced surfaces that form a slot opening radially outwardly from the aperture. The slot is sufficiently large to allow the shaft to radially enter and sufficiently small to prevent the handgrip from exiting the aperture. The prop further has a peripheral portion configured, such that when a golf club with the prop located thereon, is placed on the ground, the handgrip will remain radially spaced from the ground.

U.S. Pat. No. 4,805,911, to Ferlazzo et al., is directed to a golf club stand that is hidable in a handle. The disclosed stand includes a hinged elongated member having a stand section and a support section. In an operative mode, the stand section is disposed outside of the grip of the golf club and rotated in a plane normal to the plane of the golf club head for supporting the golf club handle above the ground. The support section remains in the handle for supporting the golf club. A finger within the handle locks the elongated member in place in either the operative mode or in an inoperative mode.

Another golf club supporting device is disclosed in U.S. Pat. No. 4,063,731, to Kitay, which is directed to a golf tool. The disclosed tool includes a number of different features which include a distance estimating facility, cleat wrench and cleaner, tee-height gauge, and cigarette holder. The tool further includes a dry-club support, for supporting the handle of a golf club. The tool has a plurality of tines that extend into the ground for supporting the tool. A cradle support is diametrically opposed to the tines for supporting the handle of the golf club above ground.

Further golf club supports are disclosed in U.S. Pat. No. 4,210,334, to Lind, and U.S. Pat. No. 4,545,579, to McCain. Each of the disclosed supports include a support means that is pivotally coupled to the handle of a golf club. The support means is pivoted away from the handle for supporting the golf club and pivoted against the handle when not in use.

Although the devices disclosed in the above enumerated prior art references have improved features, they fail to disclosed all of the advantageous features achieved by the present invention.

OBJECTS OF THE INVENTION

It is therefore an object of the present invention to provide an improved golf club stand;

- It is another object of the present invention to provide a golf club stand that retains a golf club in a substantially visible position;
- It is a further object of the present invention to provide a golf club stand that retains a golf club substantially vertical to a ground surface;
- It is yet another object of the present invention to provide a golf club stand that inhibits the grip and shaft of a golf club from becoming wet or soiled;
- It is a still further object of the present invention to provide a golf club stand that couples to a golf club and does not substantially alter the club;
- It is another object of the present invention to provide a golf club stand that may be detachably coupled to a golf club;
- It is yet a further object of the present invention to provide a golf club stand wherein a golfer does not have to bend over to retrieve a golf club retained by the stand; and
- It is another object of the present invention to provide a golf club stand that is retained in the handle end of the shaft of a golf club.

SUMMARY OF THE INVENTION

These and other objects and advantages of the present invention are achieved by providing an improved and simplified golf club stand. The present invention allows a golf club to be inverted and supported above a ground surface, such as grass. The invented stand supports the club in a substantially vertical position, so that the club's grip and shaft do not become wet or soiled. When supported in the vertical position, the club is also readily visible to the golfer, so that the club is less likely to be misplaced or forgotten.

In a first embodiment, the invented stand comprises a sleeve that is retained in the handle end of the shaft of a golf club and an elongated spike member. The sleeve is fabricated from a suitably lightweight and rigid material. The sleeve has an open end, a closed end, and a plurality of fins disposed about the outer periphery thereof. The fins extend from the open end towards the closed end, and parallel to the longitudinal axis of the sleeve. The fins exert force on the handle of the golf club to prevent the sleeve from inadvertently detaching from the club.

The sleeve is additionally provided with a pair of diametrically opposed channels that extend from the open end toward the closed end. Each channel terminates in an elongated cavity that extends perpendicular to the channel and adjacent to the closed end of the sleeve. Both cavities extend in the same direction, to aid with coupling the spike to the sleeve.

The elongated spike member comprises a spike portion having a head member at a first end and a second end. The spike portion comprises four equidistantly spaced sides, such that the spike portion has a cross-shaped cross sectional configuration. The second end of the spike is tapered for inserting the spike into the ground.

The head member is adapted to be disposed in the sleeve for detachably coupling the spike to the sleeve. The head member comprises an annular shoulder formed adjacent the spike portion and a disk shaped end positioned a predetermined distance from the shoulder. In the preferred embodiment, the distance from the shoulder to the disk end is dimensioned, such that the shoulder abuts the open end of the sleeve, when the disk end is coupled to the sleeve, for preventing inadvertent movement between the spike and the sleeve.

The disk end includes a pair of diametrically opposed tabs extending outwardly from the periphery thereof. The tabs are dimensioned to extend into the channels and cavities of the sleeve for coupling the spike to the sleeve.

In use, the head of the spike is aligned over the sleeve, with the tabs aligned with the sleeve's channels. The head is then inserted into the sleeve, with the tabs extending into the channels, until the tabs abut ends of the channels and are aligned with the cavities. The spike is then rotated perpendicular to the longitudinal axis of the sleeve, such as in a clockwise direction, so that the tabs are rotated into the cavities. The spike is rotated, approximately ninety degrees, until the tabs ends of the cavities, thus locking the spike to the sleeve. Once the spike is locked to the sleeve, the spike can be pushed into the ground, by grasping the club's shaft and pushing downwardly until the spike is imbedded in the ground. The spike is sufficiently strong to support the golf club in a position that is substantially vertical to the ground, so that the club is readily visible.

When it is desired, the club can be removed from the ground, by pulling upwardly on the club's shaft to until the spike is free of the ground. The spike is then removed from the sleeve, by rotating the spike in the opposite direction until the tabs are free of the cavities. The spike's head can then be pulled the out of the sleeve. Thus, the club is not substantially altered, and may be used normally by the golfer, without interference from the invented stand.

In a second embodiment, the golf club stand of the present invention comprises a device that is contained within the handle of a golf club. The device comprises a sleeve that is retained in the club's shaft and a retractable spike. The sleeve has an open end with a flange extending around the periphery thereof to prevent the sleeve from extending fully into the shaft. A pin member is affixed to an opposite end of the sleeve to prevent the spike from retracting fully into the sleeve and from accidentally dropping into the club's shaft. The open end is configured with a plurality of slots, forming a slotted end. An aperture having a cross-shaped cross sectional configuration is formed by the slots. The slots are provided to prevent the spike from being completely dislodged from the sleeve, while the cross-sectional configuration of the aperture enables the spike to pass through the slotted end.

The spike of the second embodiment is substantially similar to the first embodiment. The four sided spike portion is configured to extend through the slotted end of the sleeve for retracting or withdrawing the spike. The disk shaped end is disposed in the sleeve and interposed between the pin member and slots. The disk end of the spike abuts the slotted end of the sleeve, when the spike is sufficiently withdrawn, to prevent the spike from being completely dislodged from the sleeve. The spike is dimensioned, such that the tapered end of the spike does not reside in the sleeve, when the spike is fully retracted. This enables a golfer to grasp the tapered end for withdrawing the spike from the sleeve. As with the first embodiment, the spike is rotated clockwise to the longitudinal axis of the sleeve, for locking the spike to the sleeve.

When inserted in the ground, the present invention is able to support the weight of the club in the vertical position. The invented stand also aids with keeping the grip of the club dry and unsoiled, since the club is not placed on the ground. Further, since the club is retained substantially vertical to the ground, visibility of a club held by the stand of the present invention is improved, and a highly visible golf club less likely to be forgotten by the golfer after the hole is completed.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 1A is a side elevational view showing a first preferred embodiment of a spike member of a golf club stand of the present invention;

FIG. 1B is a top plan view of the spike member of the first embodiment of the present invention;

FIG. 1C is a bottom plan view of the spike member of the first embodiment;

FIG. 2A is a side elevational, cross sectional view of a handle of a golf club having a sleeve of the first embodiment of the present invention coupled thereto;

FIG. 2B is a top plan view the sleeve of the first embodiment of the present invention coupled to the handle of the golf club;

DESCRIPTION OF THE PREFERRED EMBODIMENTS

Figure 3:
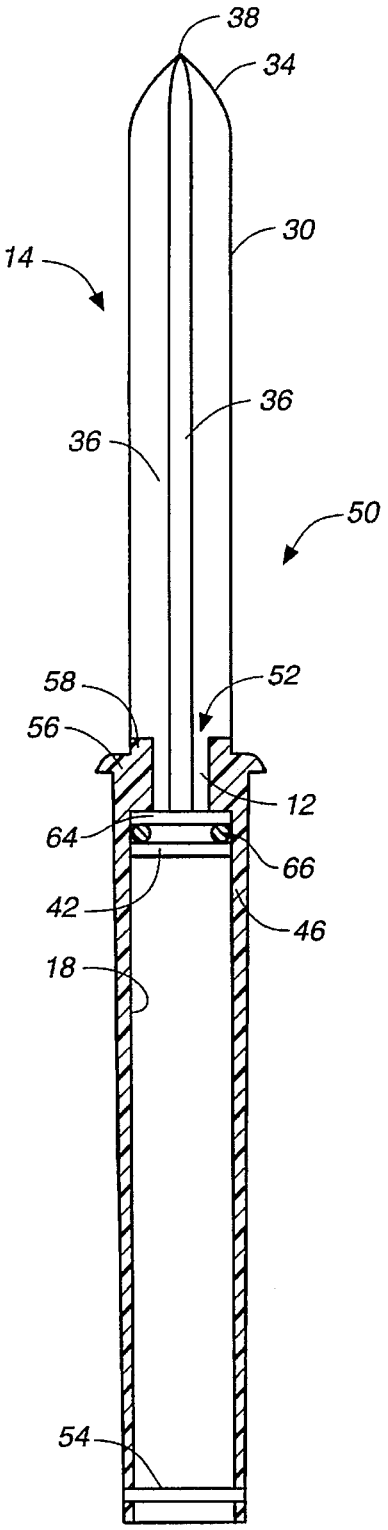
FIG. 3 is a side elevational view showing a second preferred embodiment of the golf club stand of the present invention coupled to the handle of a golf club.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

Referring now to FIGS. 1A–2B of the drawings, there is shown generally at 10 a first embodiment of a golf club stand constructed according to the principles of the present invention. The golf club stand 10 comprises a sleeve 12 and an elongated spike member 14. The sleeve 12 is retained in a handle end 16 of a shaft 18 of a golf club (not shown) and secured to the shaft 18. The sleeve 12 is cylindrical and formed complementary to the shaft 18, so that the sleeve 12 does not substantially alter the configuration or length of the shaft 18. The sleeve 12 preferably comprises a lightweight, rigid polymeric material, so that the weight of the shaft 18 is not substantially altered with the sleeve 12 is secured thereto. Thus, the first embodiment of the invented stand 10 is suitable for use with any iron or wood golf clubs commonly used by golfers.

The sleeve 12 has an open end 20 dimensioned to receive the spike 14 and a closed end 22. The sleeve 12 includes a pair of diametrically opposed channels 24 that extend from the open end 20 towards the closed end 22. Each channel 24 terminates in an elongated cavity 26. Each cavity 26 extends perpendicular to the channel 24 and adjacent to the closed end 22 of the sleeve 12. Both cavities 26 extend in the same direction, such as clockwise, for coupling the spike 14 to the sleeve 12.

The sleeve 12 further includes a plurality of fins 28 disposed about the outer periphery thereof, and which extend from the open end 20 towards the closed end 22. The sleeve 12 in the first embodiment is fabricated from a polymeric material so that the fins 28 are somewhat compressible for exerting force on the shaft 18, to secure the sleeve 12 to the shaft 18.

Referring particularly now to FIGS. 1A–1C of the drawings, the elongated spike 14 comprises a spike portion 30 that extends between a head member 32 and terminates at a tapered end 34. The spike portion 30 comprises four equidistantly spaced side plates 36, such that the spike portion 30 has a cross-shaped cross sectional configuration. The tapered end 34 terminates in a blunt point 38, for inhibiting harm from coming to a golfer using the invented stand 10. The cross sectional configuration of the side plates 36 and tapered end 34 of the spike portion 30 provide a spike 14 that is facile to imbed in a ground surface (not shown), such as grass. The spike portion 30 should be sufficiently long to enable the spike 14 to be sufficiently imbedded in the ground for supporting a golf club embodying the invented stand 10. In the first embodiment, the spike 14 is approximately 3.5 inches long, with the spike portion 30 being approximately 3 inches in length.

The head member 32 comprises an annular shoulder 40 and a disk shaped end 42. The disk end 42 is configured to be disposed through the open end 20 of the sleeve 12. The disk end 42 is formed a predetermined distance from the shoulder 40, so that when the disk end 42 engages the sleeve 12 (to be thoroughly discussed hereafter), the shoulder 40 abuts the open end 20 of the sleeve 12. This prevents movement between the spike 14 and the sleeve 12, so that the spike 14 does not inadvertently detach from the sleeve 12, for example. The disk end 42 includes a pair of diametrically opposed tabs 44 that extend outwardly from the periphery of the disk end 42. The tabs 44 are configured to extend into the channels 24 and cavities 26 of the sleeve 12 for detachably coupling the spike 14 to the sleeve 12.

Referring again to FIGS. 1A–2B of the drawings, the stand 10 supports the golf club, by first aligning the spike's disk end 42 with the sleeve's open end 20, such that the tabs 44 are aligned with the channels 24 in the sleeve 12. The disk end 42 is then disposed through the open end 20, with the tabs 44 extending into the channels 24, until the tabs 44 abut the cavities 26. The spike 14 is then rotated, approximately 90 degrees, in a predetermined direction, such as clockwise, depending upon the orientation of the cavities 26, to rotate the tabs 44 into the cavities 24. The spike 14 is rotated until the tabs 44 completely reside in the cavities 24, thus locking the spike 14 to the sleeve 12.

Once the spike 14 is attached to the sleeve 12, the spike 14 is imbedded in the ground by first inverting the golf club until the spike 14 is positioned adjacent to the ground, with the shaft 18 extending substantially vertical to the ground. The shaft 18 is then thrust downwardly, so that the tapered end 24 and spike portion 30 are sufficiently imbedded in the ground. The head member 32 is positively locked to sleeve 12 to prevent the spike 14 from detaching from the sleeve 12. The spike 14 and sleeve 12 are sufficiently strong to provide a stand 10 that supports the golf club in a substantially vertical position to the ground. The stand 10 supports the golf club in a position that is substantially vertical to the ground, for inhibiting a grip 46 on the shaft 18 from becoming wet or soiled and for providing enhanced visibility of the club. Since the shaft 18 is vertical to the ground when supported by the stand 10, the club is less likely to be forgotten by the golfer.

The spike 14 is detached from the sleeve 12 by rotating the spike 14, approximately 90 degrees, in the opposite direction. The spike 14 is rotated until the tabs 44 are removed from the cavities 26. The head member 32 can then be withdrawn from the sleeve 12, with the tabs 44 extending through the channels 24, for detaching the spike 14 from the sleeve 12. The club can again be used normally, since the spike 14 is removed from the shaft 18.

Figure 4:
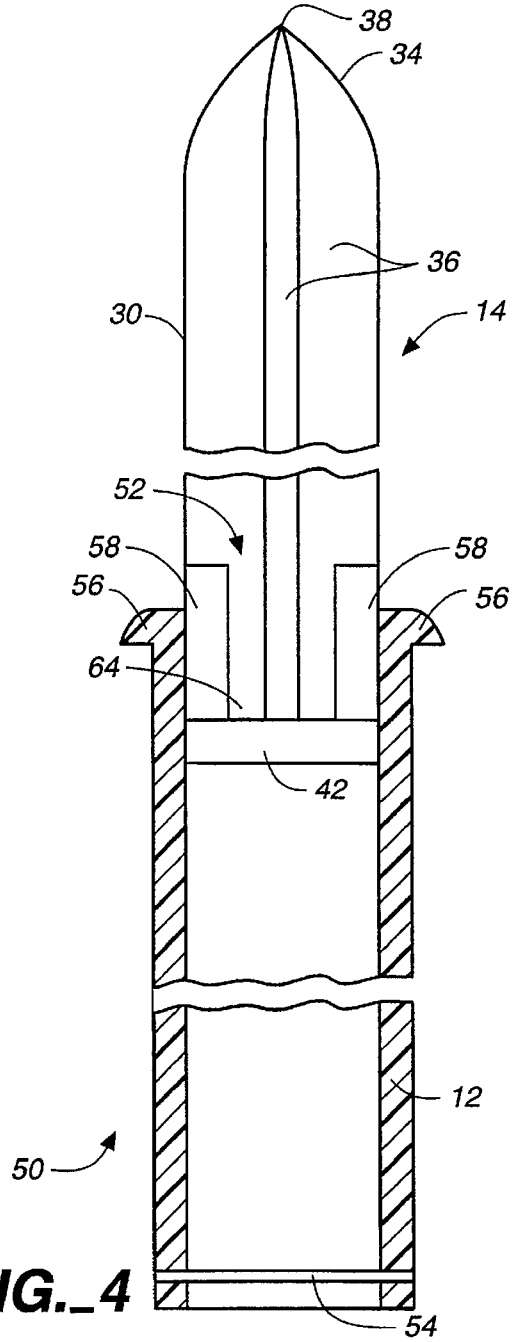
FIG. 4 is a side elevational view showing the second embodiment of the golf club stand of the present invention.
Figure 5:
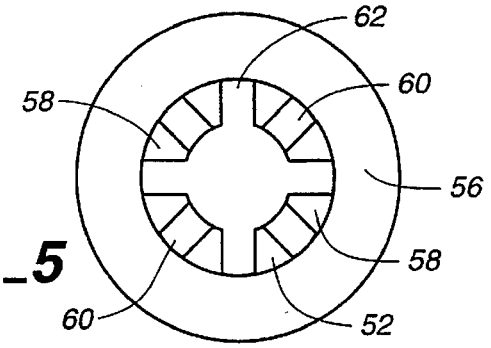
FIG. 5 is a top plan view showing a slotted open end of the sleeve of the second embodiment of the present invention.

Referring now to FIGS. 3–5 of the drawings, there is shown generally at 50, a second embodiment of the golf club stand of the present invention. In the second embodiment, the stand 50 again comprises two main components, a sleeve 12 and an elongated spike member 14. The sleeve 12 comprises a suitable lightweight, rigid, metal alloy for example, and has a slotted open end 52 and closure means 54 at a second end. The closure means 54 preferably comprises a lightweight means for preventing the spike 14 from retracting fully into the sleeve 12 and from accidentally dropping into the club's shaft 18. In the second embodiment, the closure means comprises a pin member 54 that is affixed to the sleeve 12 using known means.

Additionally, the sleeve 12 has an annular flange 56 that extends around the periphery of slotted end 52. The flange 56 is provided to prevent the sleeve 12 from being displaced within the shaft 18 and to assist with securing the sleeve 12 to the shaft 18.

The open end 52 has a plurality of ridges 58 that extend inwardly from the inner periphery of the sleeve 12, and adjacent to the open end 52. The ridges 58 are configured to form a plurality of slots 60 therebetween. The slots 60 are spatially positioned about the open end 52 to provide an aperture 62 having a cross-shaped cross sectional configuration, to enable the spike portion 30 (to be discussed hereafter) to pass through the aperture 62.

In the second embodiment, the spike 14 is slidably retained in the sleeve 12. Since the spike 14 of the stand 50 of the second embodiment of the present invention is retained in the sleeve 12, the second embodiment of the invented stand 50 is well suited for the golfer's putter, for example. The spike 14 includes a coupling portion 64 disposed in the sleeve and a spike portion 30, as previously discussed. The four equidistantly spaced side plates 36 of the spike portion 30 are configured to extend through the aperture 62, when retracting or withdrawing the spike portion 30 from the sleeve 12.

The spike 14 is dimensioned so that the length of the spike 14 is greater than the length of the sleeve 12. Particularly, the spike 14 is dimensioned so that the tapered end 34 of the spike portion 30 remains out of the slotted end 52, when the spike 14 is retracted within the sleeve 12. This enables the golfer to grasp the tapered end 34 for withdrawing the spike 14 from the sleeve 12 to use the invented stand 50.

The coupling portion 64 includes a disk shaped end 42, as with the first embodiment. However, in the second embodiment, the disk end 42 prevents the spike 14 from being dislodged from the sleeve 12, when the spike portion 30 is withdrawn from the sleeve 12. The circumference of disk end 42, causes the disk 42 to abut the plurality of ridges 58 of the slotted end 52, to prevent the spike 14 from dislodging from the sleeve 12. The disk 42 further abuts the closure means 54, when the spike 14 is completely retracted into the sleeve 12, so that the spike 14 is not dislodged within the shaft 18. The coupling portion 64 and sleeve 12 are provided with means for interlocking the spike 14 to the sleeve 12, is discussed with reference to the first embodiment 10.

Further, the coupling portion 64 may be provided with an annular polymeric ring member or O-ring 66. The O-ring 66 is disposed about the coupling portion 64, between the disk end 42 and spike portion 30, for inhibiting dirt or moisture from collecting in the sleeve 12 and in the shaft 18.

Referring still to FIGS. 3–5 of the drawings, the second embodiment 50 of the golf club stand of the present invention is used to support a golf club, by first rotating the spike 14, approximately 90 degrees, to align the side plates 36 with the slots 60, to enable the spike portion 30 to pass through the aperture 62, for withdrawing the spike portion 30 from the sleeve 12. The spike 14 is rotated until the coupling portion 64 engages the sleeve 12, to secure the spike 14 in an extended position (as shown in the drawings). The spike 14 is then embedded in the ground as previously discussed. When the spike 14 is inserted into the ground, the spike 14 is able to support the weight of the club in the upright position. Thus, the golf club stand of each of the embodiments 10, 50 of the present invention retain the club in a substantially vertical position, so that the club's grip and shaft do not become wet or soiled.

When it is desired to move the club, the stand 50 may be removed from the ground, by pulling upwardly on the shaft 18 of the club until the spike 14 is withdrawn from the ground. The spike 14 is then rotated to disengage the coupling portion 64 from the sleeve 12. The slide plates 36 of the spike portion 30 are aligned with the aperture 62, to enable the spike portion 30 to pass through the aperture 62. The spike portion 30 is retracted into the sleeve 12, until the disk end 42 abuts the closure means 54 and the tapered 34 remains slightly out of the sleeve's slotted end 54.

Thus, there has been described an improved golf club stand. The present invention allows a golf club to be inverted and supported above a ground surface, such as grass. The invented stand supports the club in a substantially vertical position, so that the club's grip and shaft do not become wet or soiled. When supported in the vertical position, the club is also readily visible to the golfer, so that the club is less likely to be misplaced or forgotten by the golfer.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A golf club including a stand for supporting the golf club, the golf club including a shaft having a handle end, the stand comprising:

a hollow cylindrical sleeve retained in the handle end of the shaft and secured thereto, the sleeve having an open end, a closed end, and receiving means; and an elongated spike member having a head member at a first end and a tapered second end, the tapered second end for imbedding the spike into a ground surface for securing the stand to the ground, the head member comprising an annular shoulder and a disk shaped end positioned a predetermined distance from the shoulder, the disk end configured to be disposed through the open end of the sleeve and including locking means for coupling to the receiving means for detachably coupling the spike to the sleeve, the disk end formed a predetermined distance from the shoulder, such that when the locking means are coupled to the receiving means, the shoulder abuts the open end of the sleeve for preventing inadvertent movement between the spike and the sleeve, whereby the stand supports the golf club by disposing the head member through the open end of the sleeve until the locking means of the disk end couple to the receiving means to detachably couple the spike to the sleeve, upon coupling the spike to the sleeve, imbedding the spike in the ground by inverting the golf club until the spike is positioned adjacent to the ground and with the shaft extending substantially vertical to the ground, thrusting the spike into the ground until the spike is imbedded therein, the stand sufficiently rigid to support the golf club in a position that is substantially vertical to the ground providing enhanced visibility of the club when supported by the stand.

2. The golf club and stand of claim 1 wherein the stand further comprises:

the receiving means comprising a pair of diametrically opposed channels that extend from the open end toward the closed end of the sleeve, each channel terminating in an elongated cavity that extends perpendicular to the channel and adjacent to the closed end of the sleeve, both of the cavities extending in a predetermined direction for coupling the head member to the sleeve; and the locking means comprising a pair of diametrically opposed tabs extending outwardly from the periphery of the disk end of the spike, the tabs configured to extend into the channels and cavities of the sleeve for coupling the spike to the sleeve, whereby the spike is detachably coupled to the sleeve by aligning disk end of the spike with the open end of the sleeve, the tabs aligned with the channels in the sleeve, the disk end being disposed through the open end of the sleeve with the tabs extending into the channels, the disk end disposed through the sleeve until the tabs abut the cavities, the spike then rotated in the predetermined direction, depending upon the orientation of the cavities, for rotating the tabs into the cavities, thus locking the spike to the sleeve, and whereby the spike is detached from the sleeve by rotating the spike, such that the tabs are removed from the cavities, the head member being withdrawn from the sleeve for detaching the spike from the sleeve.

3. The golf club and stand of claim 2 wherein the sleeve comprises a lightweight, rigid polymeric material, the sleeve further including a plurality of fins disposed about the outer periphery thereof, the fins extending from the open end towards the closed end of the sleeve, the fins being compressible for exerting a force on the shaft of the golf club for securing the sleeve to the club.

4. The golf club and stand of claim 1 wherein the spike member further comprises:

an elongated spike portion that extends between the head member and terminates at the second end, the spike portion comprising four equidistantly spaced side plates, such that the spike portion has a cross-shaped cross sectional configuration, the tapered second end terminating in a blunt point for imbedding the spike in the ground.

5. The golf club and stand of claim 4 wherein the spike portion of the spike member is approximately two and one half inches in length.

6. A golf club including a stand for supporting the golf club, the golf club including a shaft having a handle end, the stand comprising:

a hollow cylindrical sleeve retained in the handle end of the shaft and secured thereto, the sleeve including an open first end, receiving means, and closure means at a second end, the sleeve having an annular flange extending around the periphery of the open end to aid with securing the sleeve to the shaft and to prevent the sleeve from being displaced within the shaft, the open end having a plurality of ridges extending inwardly from the inner periphery of the sleeve adjacent to the open end for forming a plurality of slots therebetween, the slots spatially positioned about the inner periphery to provide an aperture having a cross-shaped cross sectional configuration; and an elongated spike member slidably retained in the sleeve, the spike having a coupling portion disposed in the sleeve and a spike portion, the spike portion comprising four equidistantly spaced side plates configured to extend through the aperture for retracting or withdrawing the spike from the sleeve, the spike dimensioned such that the length of the spike is greater than the length of the sleeve so that a second end of the spike does not reside within the sleeve when the spike is retracted therein, the coupling portion including a disk shaped end for abutting the plurality of ridges of the sleeve to prevent the spike from being dislodged from the sleeve when the spike is withdrawn therefrom, the disk end further abutting the closure means when the spike is retracted in the sleeve so that the spike is not dislodged in the shaft of the club, the coupling portion including means for locking the spike to the sleeve to prevent inadvertent movement between the spike and sleeve when the spike is withdrawn therefrom, whereby the stand is secured to the ground by rotating the spike to align the side plates thereof with the slots in the open end of the sleeve enabling the spike portion to pass through the aperture for withdrawing the spike portion from the sleeve, the spike being rotated until the locking means engage the receiving means for securing the spike in an extended position, imbedding the spike in the ground by inverting the golf club until the spike is positioned adjacent to the ground with the shaft extending substantially vertical to the ground, and thrusting the spike into the ground until the spike is imbedded therein, the stand sufficiently rigid to support the golf club in a position that is substantially vertical to the ground, and whereby the stand is removed from the ground, by pulling upwardly on the shaft of the club until the spike is withdrawn from the ground, rotating the spike to disengage the locking means from the receiving means, aligning the side plates of the spike with the slots in the open end of the sleeve to enable the spike portion to pass through the aperture, and retracting the spike into the sleeve.

7. The golf club and stand of claim 6 further comprising an annular polymeric ring member, the ring coupled to the coupling portion for inhibiting dirt or moisture from collecting in the sleeve and in the shaft of the golf club.

8. The golf club and stand of claim 7 wherein the sleeve comprises a lightweight, rigid metal alloy.

9. The golf club and stand of claim 6 wherein the stand further comprises:

the receiving means comprising a pair of elongated cavities, the cavities formed adjacent the plurality of ridges and extending perpendicular to a longitudinal axis of the sleeve, both of cavities extending in a predetermined direction for coupling the locking means of the coupling portion to the sleeve; and the locking means comprising a pair of diametrically opposed tabs extending outwardly from the periphery of the disk end, the tabs configured to engage the cavities for retaining the spike in the extended position.

10. The golf club and stand of claim 6 wherein the second end of the spike portion is tapered and terminates in a blunt point, the cross sectional configuration and tapered end of the spike portion providing a spike that is facile to imbed in a ground surface.

11. The golf club and stand of claim 6 wherein the closure means comprises a pin member affixed to the second end of the sleeve and extending across the second end, the pin member preventing the disk end of the spike from extending through the sleeve to prevent the spike from being dislodged in the shaft of the club.

12. A golf club including a stand for supporting the golf club, the golf club including a shaft having a handle end, the stand comprising:

a hollow cylindrical sleeve retained in the handle end of the shaft of the golf club and secured thereto, the sleeve having an open end, closure means at a second end, and receiving means, the sleeve comprising a lightweight, rigid material and formed complementary to the shaft, so that the sleeve does not substantially alter the weight, configuration, and length of the shaft; and a rigid spike member, the spike comprising a coupling portion and an elongated spike portion, the spike portion comprising four equidistantly spaced side plates for forming a cross-shaped cross sectional configuration, the spike portion having a tapered end terminating in a blunt point, the cross sectional configuration and tapered end of the spike portion providing a spike that is facile to imbed in a ground surface, the coupling portion including locking means for engaging the receiving means of the sleeve for retaining the spike in an extended position and for preventing inadvertent movement between the spike and sleeve, the sleeve, in combination with the locking means engaging the receiving means, being sufficiently strong to retain the spike in the extended position to provide a stand that supports the golf club in a substantially vertical position to the ground, the stand sufficiently strong to support the golf club in a position that is substantially vertical to the ground for inhibiting a grip on the handle end of the shaft from becoming wet or soiled and for providing enhanced visibility of the club when supported by the stand.

13. The golf club and stand of claim 12 wherein the sleeve comprises a lightweight, rigid polymeric material, the sleeve further including a plurality of fins disposed about the outer periphery thereof, the fins extending from the open end towards the closed end of the sleeve, the fins being compressible for exerting a force on the shaft of the golf club for securing the sleeve to the club.

14. The golf club and stand of claim 12 further comprising an annular polymeric ring member, the ring coupled to the coupling portion for inhibiting dirt or moisture from collecting in the sleeve and in the shaft of the golf club.

15. The golf club and stand of claim 12 wherein the closure means at the second end of the sleeve comprises a pin member affixed to the sleeve and extending across the second end, the pin member preventing the coupling portion of the spike from extending through the sleeve to prevent the spike from being dislodged in the shaft of the club.

* * * * *